US009809777B2

(12) United States Patent
Pozarnsky

(10) Patent No.: US 9,809,777 B2
(45) Date of Patent: Nov. 7, 2017

(54) PROCESS FOR PRODUCING LUBRICANTS CONTAINING NANOPARTICLES

(71) Applicant: Gary A. Pozarnsky, Roseville, MN (US)

(72) Inventor: Gary A. Pozarnsky, Roseville, MN (US)

(73) Assignee: Applied Colloids, Inc, Roseville, MN (US)

( * ) Notice: Subject to any disclaimer, the term of this patent is extended or adjusted under 35 U.S.C. 154(b) by 0 days.

(21) Appl. No.: 14/705,934

(22) Filed: May 6, 2015

(65) Prior Publication Data

US 2016/0326449 A1 Nov. 10, 2016

(51) Int. Cl.

| | |
|---|---|
| ***B22F 9/06*** | (2006.01) |
| ***C10M 125/04*** | (2006.01) |
| ***C10M 177/00*** | (2006.01) |
| *B22F 9/08* | (2006.01) |

(52) U.S. Cl.
CPC ..... *C10M 125/04* (2013.01); *C10M 177/00* (2013.01); *B22F 2009/0864* (2013.01); *C10N 2210/05* (2013.01); *C10N 2220/082* (2013.01); *C10N 2230/06* (2013.01); *C10N 2250/10* (2013.01)

(58) Field of Classification Search
CPC ..... B22F 2009/086; B22F 2009/0864
See application file for complete search history.

(56) References Cited

U.S. PATENT DOCUMENTS

2003/0116228 A1* 6/2003 Pozarnsky ..... B22F 1/0018 148/251

* cited by examiner

*Primary Examiner* — Jessee Roe
*Assistant Examiner* — Ngoclan T Mai
(74) *Attorney, Agent, or Firm* — Henry E Naylor

(57) ABSTRACT

The use of nanoparticles of a metal melting below 400° C., preferably bismuth, dispersed in a lubricant for providing a low coefficient of friction coating to interacting surfaces of machinery, such as a powertrain of a motor vehicle.

11 Claims, 6 Drawing Sheets

SEI 5.0kV X30,000 100nm WD 10.1mm

PROCESS FOR PRODUCING LUBRICANTS CONTAINING NANOPARTICLES

CROSS-REFERENCE TO RELATED APPLICATIONS

This a Non-Provisional Application based on Provisional application 61/989,480 filed May 6, 2014.

FIELD OF THE INVENTION

This invention relates to the use of nanoparticles of a metal melting below 400° C., preferably bismuth, dispersed in a lubricant for providing a low coefficient of friction coating to interacting surfaces of machinery, such as a powertrain of a motor vehicle.

BACKGROUND OF THE INVENTION

Friction between interacting surfaces of machinery, particularly machinery operating at elevated temperatures and having interacting parts, is a major cause of power consumption and wear. The reduction of friction is a major goal for improving fuel efficiency and for lowering power consumption and wear. For example, friction resulting from interacting surfaces in automobiles and other vehicles accounts for about one third of the total fuel consumed. Also, for wind turbines, up to one quarter of operating and maintenance costs are due to replacement of worn equipment. One approach for reducing friction resulting from interacting surfaces of machinery is the use of low coefficient of friction coatings on such interacting surfaces. The application of low coefficient of friction coatings on interacting machine parts during manufacturing of the machine is difficult, if not impossible, because it requires that interacting parts be coated prior to assembly into the final product. Conventional coatings used to provide low coefficients of friction typically have a micron size grain structure as opposed to a nano-size grain structure. One such conventional coating is a diamond coating that is expensive to implement into conventional manufacturing processes. In addition, conventional coating processes do not result in coatings that are capable of preserving the designed clearances between interacting surfaces.

Therefore, there is a need in the art for coatings that will provide: a low coefficient of friction between interacting surfaces; will preserve designed clearances between interacting surfaces; have superior wear properties, and that are cost effective to apply.

SUMMARY OF THE INVENTION

A process for preparing a lubricant having superior coefficient of friction properties, which lubricant is prepared in a system comprised of a heating zone, a lubricant contacting zone, and a collecting zone, wherein all zones are under a vacuum, which process comprising:

a) placing a sample of elemental metal having a melting point less than 400° C. in a heating zone capable of being heated to a temperature of up to about 2000° C.;

b) heating said sample of elemental metal to a temperature between about 900° C. and 1800° C. thereby causing at least a fraction of the elemental metal to melt and evaporate resulting in the formation of nanoparticles, nanodroplets or both;

c) passing a stream of inert gas through the heating zone so that it passes over the evaporating metal sample and forms a mixture of inert gas and metal nanoparticles, nanodroplets, or both;

d) conducting said mixture of inert gas and metal nanoparticles, nanodroplets, or both to a lubricant contacting zone wherein the mixture of inert gas and metal nanoparticles, nanodroplets, or both come into intimate contact with a mist of lubricant thereby quenching said nanoparticles and nanodroplets to nanoparticles; and e) conducting said quenched metal nanoparticles to a collection zone wherein the inert gas is separated from a dispersion of metal nanoparticles in lubricant.

DETAILED DESCRIPTION OF THE INVENTION

Figure 1:
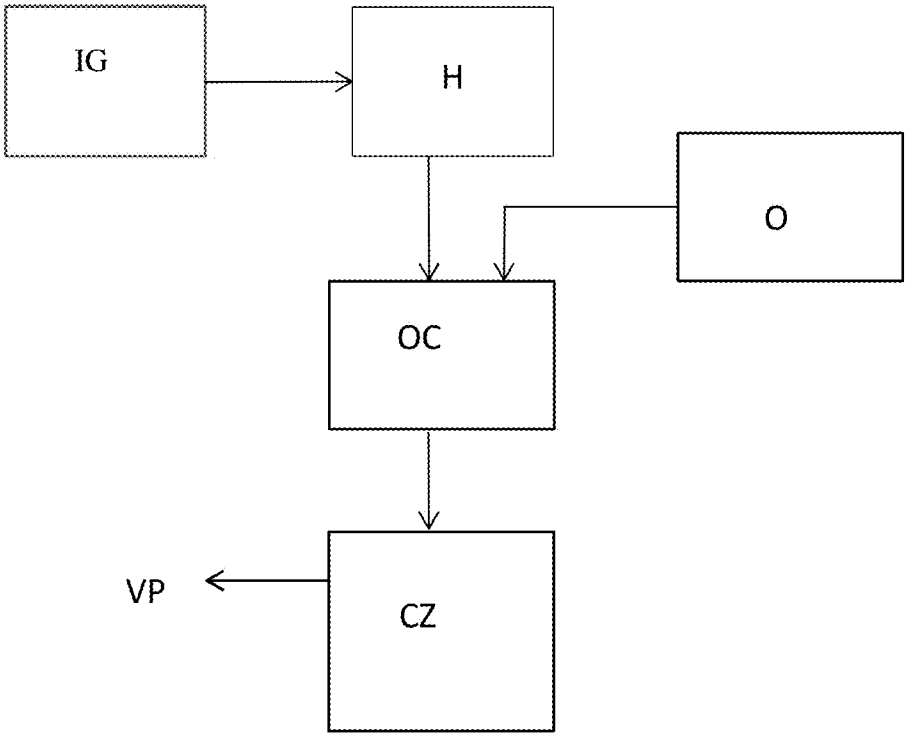
FIG. 1 hereof a simplified process flow diagram showing one preferred embodiment for the practice the present invention.

The present invention relates to a method for providing low coefficient of friction coatings having a thickness and grain structure in the nanometer size range and that are capable of preserving the designed clearances between interacting surfaces in machinery requiring lubrication. The present invention is based on a dispersion of nanoparticles of a low melting metal in a lubricant. That is a metal having a melting point less than about 400° C. Such metals include bismuth, cadmium, tin, indium, and lead all of which melt below about 400° C. Bismuth is preferred and as such this application will be written primarily in terms of bismuth. The bismuth nanoparticle oil dispersions of the present invention will initially be introduced into the oil reservoir for the machinery, such as an engine crankcase, gearbox, or a transmission. The machinery is then operated under normal operating conditions, preferably under startup conditions, for an effective amount of time. By effective amount of time we mean for at least that amount of time wherein at least an effective percent of the interacting surfaces are at least partially coated with the bismuth nanoparticle coating of the present invention. By at least an effective percent of interacting surfaces coated we mean that at least that amount of coating is applied that will result in at a least 25%, preferably at least a 40%, and more preferably at least a 60% decrease in coefficient of friction compared to the same lubricant but without a dispersion of bismuth nanoparticles.

Any suitable lubricant can be used in the practice of present invention. Preferred lubricants are low volatility lubricating oils. Typical lubricating oils are by necessity low volatility to withstand high operating temperatures. Such oils are prepared from a variety of natural and synthetic base stocks admixed with various additive packages and solvents depending upon their intended application. Modern base stocks for automobile engines typically include mineral oils, polyalphaolefins (PAOs), gas-to-liquid (GTL), silicone oils, phosphate esters, diesters, polyol esters, and the like. Preferred low volatility oils are those that will typically be used as the lubricant for the machinery to be treated.

Oils of lubricating viscosity useful in the practice of the present invention can be selected from natural lubricating oils, synthetic lubricating oils, mixtures thereof, as well as greases. Natural oils include animal oils and vegetable oils (e.g., castor oil, lard oil); liquid petroleum oils and hydrorefined, solvent-treated or acid-treated mineral oils or the paraffinic naphthenic and mixed paraffinic-naphthenic types. Oils of lubricating viscosity derived from coal or shale also serve as useful base oils. Synthetic lubricating oils include hydrocarbon oils and halo-substituted hydrocarbon oils such as polymerized and interpolymerized olefins, alkylbenzenes; polyphenyls; and alkylated diphenyl ethers and alkylated diphenyl sulfides and derivative, analogs and homologs thereof. Alkylene oxide polymers, and interpolymers and derivatives thereof where the terminal hydroxyl groups have been modified by esterification, etherification, etc., constitute another class of known synthetic lubricating oil. Another suitable class of synthetic lubricating oils suitable for practice of the present invention comprises the esters of dicarboxylic acids with a variety of alcohols (e.g., butyl alcohol, hexyl alcohol, dodecyl alcohol, 2-ethylhexyl alcohol, ethylene glycol, diethylene glycol monoether, propylene glycol).

Further, the oil used in the practice of the present invention may comprise a Group I, Group II, Group III, Group IV or Group V oil or blends of the aforementioned oils. The oil may also comprise a blend of one or more Group I oils and one or more of Group II, Group III, Group IV or Group V oil. Definitions for the oils as used herein are the same as those found in the American Petroleum Institute (API) publication "Engine Oil Licensing and Certification System", Industry Services Department, Fourteenth Edition, December 1996, Addendum 1, December 1998.

As was previously mentioned, the lubricant used in the practice of the present invention can also be a grease. Greases are typically comprised of oil and/or other fluid lubricant that is mixed with a thickener, typically a soap to form a solid or semisolid. Greases are a type of shear-thinning or pseudo-plastic fluid, which means that its viscosity is reduced under shear. After sufficient force to shear the grease has been applied, the viscosity drops and approaches that of the base lubricant, such as a mineral oil. This sudden drop in shear force means that grease is considered a plastic fluid, and the reduction of shear force with time makes it thixotropic. Grease is typically manufactured by first mixing together a mineral oil base stock, a fatty acid or fatty acid ester and an alkali metal salt such as lithium hydroxide. The soap base stock usually contains about 50% of the final oil content of the grease.

Since bismuth nanoparticles of the oil dispersion of the present invention will range in size from about 2 nm to about 200 nm, preferably from about 2 nm to about 100 nm, and more preferably from about 2 nm to about 60 nm. The thickness of the coatings formed will also be in the nano-size range. The coatings of the present invention are substantially superior to conventional coatings intended to reduce the coefficient of friction on interacting surfaces of machinery. For example, as previously mentioned, conventional coatings typically have a micron size grain structure whereas the coatings of the present invention have a nanosize grain structure. This nanosize grain structure results in stronger and harder coatings that have superior wear properties compared to conventional micron size grain structure coatings. The coatings of the present invention, because they are substantially thinner than conventional low coefficient of friction coatings, help maintain the designed low clearances between interacting surfaces of machinery. Another advantage of the process of the instant invention is that conventional processes for applying low coefficient of friction coatings require that the interacting surfaces of a particular piece of machinery be treated with the low coefficient of friction coating prior to assembly of the machinery. In contrast, practice of the present invention can treat the same interacting surfaces with a substantially thinner and harder and more wear resistant coating after the equipment has already been assembled and during its normal operating conditions. This can simply be done by replacement of the intended conventional lubricating oil with the novel bismuth nanoparticle lubricating oil dispersion of this invention. The bismuth nanoparticle dispersion of the present invention can be replaced periodically as with conventional lubricating oils. Also, after the removal of the novel bismuth nanoparticle oil dispersion from the machinery, a conventional lubricating oil, without the novel bismuth nanoparticle additives of the present invention, can be used in the treated machinery and normal operation can continue with reduced friction and wear between the interacting parts because the interacting parts will now have a long lasting coating of bismuth nanoparticles.

Other methods, such as dry collection on the vacuum chamber walls or on filters, can be utilized, but this often causes undesirable agglomeration of the nanoparticles. If this happens, it is difficult to break down these agglomerates into smaller more desirable nanoparticles with current methods, such as media milling. Wet collection in low volatility lubricating oils not only provides a liquid/solids dispersion, but it also quenches the molten nanoparticles in their solid state and preserves the desired nanoparticle size distribution before they are able to form larger particles. It also prevents undesired oxidation of the reactive metal nanoparticles. Although other liquid collection methods, such as sparging the nanoparticle gas stream through the low volatility lubricating oil, or contacting with a film of oil, can be used to form a nanoparticle in oil dispersion, spray collection is preferred. This is because spray collection provides a more intimate contact between the lubricating oil and the hot nanoparticles and nanodroplets of molten metal. Without the oil spray cooling process, it is difficult to form a stable nanoparticle particle size distribution containing smaller nanoparticles with low melting points (540° C. and below).

The heating source for the melting and vaporization of the bismuth, or other suitable metal, can be any source that is capable of providing a relatively constant temperature between about 900° C. and 1800° C., preferably between about 1200 and 1600° C. Non-limiting examples of heating sources that can be used in the practice of the present invention include filament heating and other associated methods, and induction heating. Induction heating is preferred, particularly using a pressed graphite crucible to melt and evaporate the metal. It is also preferred that "bumping" of the melted liquid metal be prevented while the metal is heated in the evaporation crucible. Bumping can lead to the formation of undesirable large micron-size metal droplets. One preferred method to prevent "bumping" is to place a piece of refractory material in the crucible with the melted metal to mitigate and preferably eliminate bumping. The refractory material must be one that will not undergo any chemical or physical changes at the temperatures employed. It is preferred that the refractory material be porous, such as a piece of porous carbon foam. As the metal vapor rises from the crucible during heating, it comes into contact with the inert gas which provides back pressure in the system that results in the formation of nano-droplets and nanoparticles from condensation of the molten metal vapor. The inert gas stream, containing metal nano-droplets and nanoparticles, is passed through a stream of atomized low volatility lubricating oil and comes into intimate contact with the newly formed bismuth nanodroplets and nanoparticles. The vapor pressure of the lubricating oil must be low enough so that an undesirable amount does not vaporize in the system and raise the background pressure in the system beyond the capacity of the vacuum pumps. The oil can be heated to insure proper atomization within the system. The oil can also contain one or more non-aqueous stabilizing agents, such as lecithin, in addition to other compounds typically found in lubricating oils to prevent agglomeration, such as magnesium sulfonate, wear, such as tricresyl phosphonate; and oxidation, such amines and phenols. Other lubricant properties, such as pour point and viscosity, can be modified with the addition of polyalkylmethacrylates and polyolefins, respectively.

After formation, the bismuth nanoparticle/oil dispersion can be filtered through a 200 mesh or greater wire filter to separate out the larger particles and agglomerates that may have formed from molten liquid buildup on the walls and piping of the system. At this point, the oil dispersion can be utilized as a low viscosity lubricant whose performance is enhanced over that of conventional lubricants for the intended machinery, even after an initial run time in the machinery and after the formation of the a low friction nano-coating on interacting parts. However, it is preferred to remove the bismuth nanoparticle oil dispersion after an initial run time and after the formation of a low friction nano-coatings has formed on the interacting surfaces. The coefficient of friction for the nanoparticle oil dispersion is higher than that of virgin lubricating oil typically used for the system, so it is beneficial to remove the bismuth nanoparticle oil dispersion from the system and replace it with virgin lubricant. The bismuth oil dispersion can also be utilized as a component in various grease formulations.

Figure 2:
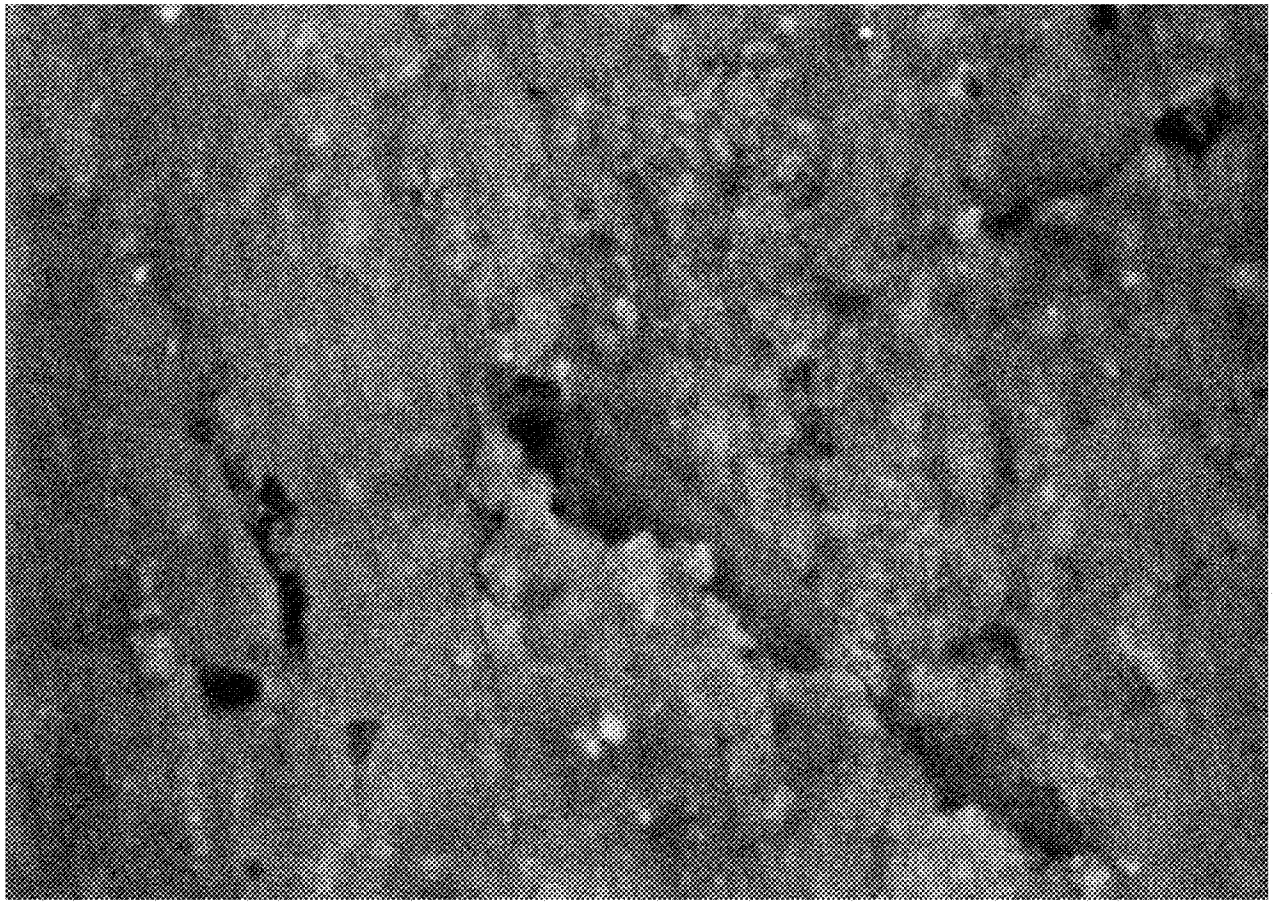
FIG. 2 hereof is a scanning electron photomicrograph of a metal surface coated with a bismuth nanoparticle coating of the present invention. This photomicrograph shows that the nano-coating resembles a "cobblestone" structure where the larger, unmelted nanoparticles are dispersed in the smaller, melted nanoparticle, which act as a binder both to the interacting surfaces and for the larger, solid nanoparticles of the nano-coating.

The bismuth nanoparticle particle size distribution can be tailored to a specific operating temperature range of the intended equipment/machinery. For example, every particle size distribution will have an optimum temperature at which a low coefficient of friction nano-coating can be formed on interacting parts. The nano-coating formation occurs by the melting and sintering of the smaller bismuth nanoparticles in the typical bell shaped particle size distribution curve Nanoparticles smaller than the mean diameter in the particle size distribution will sinter and melt while the larger nanoparticles will remain substantially solid. At effective concentrations, of bismuth nanoparticles in the lubricating oil (typically below 2 wt. %), low coefficient of friction coatings are formed on the interacting surfaces. The concentration of nanoparticles dispersed in the lubricant will range from about 0.02 wt. % to about 2 wt. % based on the total weight of lubricant plus nanoparticles. The entire interacting surfaces will not need to be covered with the coating of the present invention as long as an effective discontinuous coating is formed on the interacting surfaces to provide an effective decrease in coefficient of friction. An example of nano-coatings formed by practice of the invention is shown in FIG. 2 hereof. The coating, as illustrated in this FIG. 2 hereof resembles a "cobblestone" structure where the larger, unmelted nanoparticles are dispersed in the smaller, melted nanoparticles. The melted nanoparticles act as a binder both to the interacting surfaces and for the larger, solid nanoparticles of the nano-coating. The coating illustrated in FIG. 2 hereof was obtained with bismuth nanoparticles having an average size of about 60 nm in a turbine oil at 75° C. The binding action to the contacting surface can include alloying to the metal of the surface.

The formation of the low coefficient of friction nano-coating of the present invention is dependent on such things as the operating temperature of the equipment or machinery containing the nanofluid and concentration of bismuth nanoparticles in the nanofluid. The term "nanofluid" is introduced herein to mean the nanoparticle/lubricant dispersion used to coat interacting parts. Below the crucial temperature for a substantially constant temperature where the smaller nanoparticles in the particle size distribution start to sinter and begin to adhere to the interacting surfaces and to other nanoparticles, the nanoparticles will simply roll between the interacting surfaces and act as ball bearings between the surfaces. This will have friction reducing effect on the friction between the interacting surfaces. As the temperature increases, a temperature is reached where the smaller nanoparticles melt and sinter and act as a binding agent between the larger, umelted nanoparticles and the contacting surfaces, forming the nanocoating. As the temperature increases further, the ability of the bismuth nanoparticles to form a low coefficient of friction nano-coatings is compromised and the action of the interacting surfaces results in the formation of larger particle agglomerates of the nanoparticles instead of pressing the melted/unmelted nanoparticles onto the interacting surfaces and forming a nano-coating. To compensate for this effect, a decrease in the concentration bismuth nanoparticles in the lubricating oil, as the temperature increases, allows for the formation of a nano-coating having substantially the same particle size distribution; however, the nano-coatings formed will not be as continuous as at the lower temperature and will not result in the desired decrease in the coefficient of friction. Successive treatments with nanoparticle/lubricating oil dispersion of substantially the same concentration will further decrease the coefficient of friction. Eventually, a coefficient of friction will be obtained which is near, or identical to, that of a pure bismuth coating on the interacting surfaces. The concentration of the bismuth nanoparticles in the lubricating oil must be sufficient to contact each of the interacting surfaces and allow the nano-coatings to form.

The Table below shows the relationship of operating temperature of the machine having interacting surfaces treated in accordance with the present invention vesus mean particle size of the nanoparticles. However, due to the dependence of the nano-coating formation on both the concentration of the bismuth nanoparticles and the particle size distribution, there is overlap of the various operating ranges. This indicates the mean particle size range preferred at various temperatures of the operating machinery, such as gearboxes, transmissions, engines, etc, can be altered by adjustment of the bismuth nanoparticle concentration. Conversely, the nano-coating formation can occur by the addition of the lower melting particle size distribution to a higher melting particle size distribution to form thicker nanocoatings of bismuth material at temperatures where the higher melting point distribution would not form an effective nanocoating.

Relationship of Temperature and Particle Size

| Mean Particle Size | Operating Temperature |
|---|---|
| 2 to 30 nm | −40° C. to 60° C. |
| 30 nm to 100 nm | 60° C. to 120° C. |
| 100 nm to 200 nm | 120° C. to 200° C. |

The following examples are presented for illustrative purposes only and are not to be taken as limiting the present invention in any way.

The process of the present invention generally involves the evaporation of bismuth metal in an inert gas condensation process under a vacuum. FIG. 1 hereof is simplified flow diagram of one preferred embodiment of the process of the present invention and the method used to obtain the bismuth nanoparticle in lubricating dispersion used in the following examples. This figure shows a heating zone H, an oil contacting zone OC, and a collecting zone CZ. All three zones are under vacuum by use of vacuum pump VP A sample of bismuth to be melted and evaporated is placed in a crucible (not shown) in heating zone H and heated to a temperature between about 900° C. to about 1800° C., preferably to a temperature of about 1200° C. to about 1600° C. At these temperatures the bismuth, or other low melting metal, will melt and evaporate. It is preferred that only the metal sample and crucible be located in the heating zone because of the high temperatures employed. Any ancillary induction coils and piping will be located outside of the heating chamber. The addition of an inert gas into heating zone H allows for the formation of the nanoparticles. Vacuum pumps VP will keep the system pressure at effective levels for the formation of various nanoparticle sizes. In order to assure that a desired low nanoparticle size distribution be obtained, it is preferred that turbulent flow of inert gas be avoided. Turbulent and high velocity gas flows will have a tendency to destroy the intended particle size distribution of the newly formed bismuth nanoparticles owing to the low melting and sintering temperature of the bismuth nanoparticles. It is believed that this is due to increased collisions at turbulent flow between the newly formed nanoparticles which leads to undesirable agglomeration and aggregate formation. At the high operating temperatures of the process of the present invention the nanoparticles can fuse owing to the low melting temperature of bismuth (237° C.). In addition, nanoparticles contacting each other can also fuse at temperature below their melting point due to their high surface area. This can prevent the formation of the desired and targeted particle size distribution. The newly formed nanoparticles and inert gas are conducted into spray chamber oil contacting zone OC wherein they are contacted with a lubricant in the form of a mist or an atomized spray from oil source O. It is preferred that the lubricant or oil be sprayed into the spay chamber so that there is more intimate contacting of the newly formed nanoparticles with the lubricant. The nanoparticles are preferably immediately captured within the spray of lubricant in order to preserve the desired bismuth nanoparticle size distribution. The resulting bismuth nanoparticle in lubricating oil dispersion is then conducted into collection vessel CZ. The concentration of nanoparticles in lubricating oil will typically be less than 1 wt. %, more typically less than 0.5 wt. %. Additional lubrication oil can be used as a diluent to obtain a specific concentration.

Example 1

Figure 3:
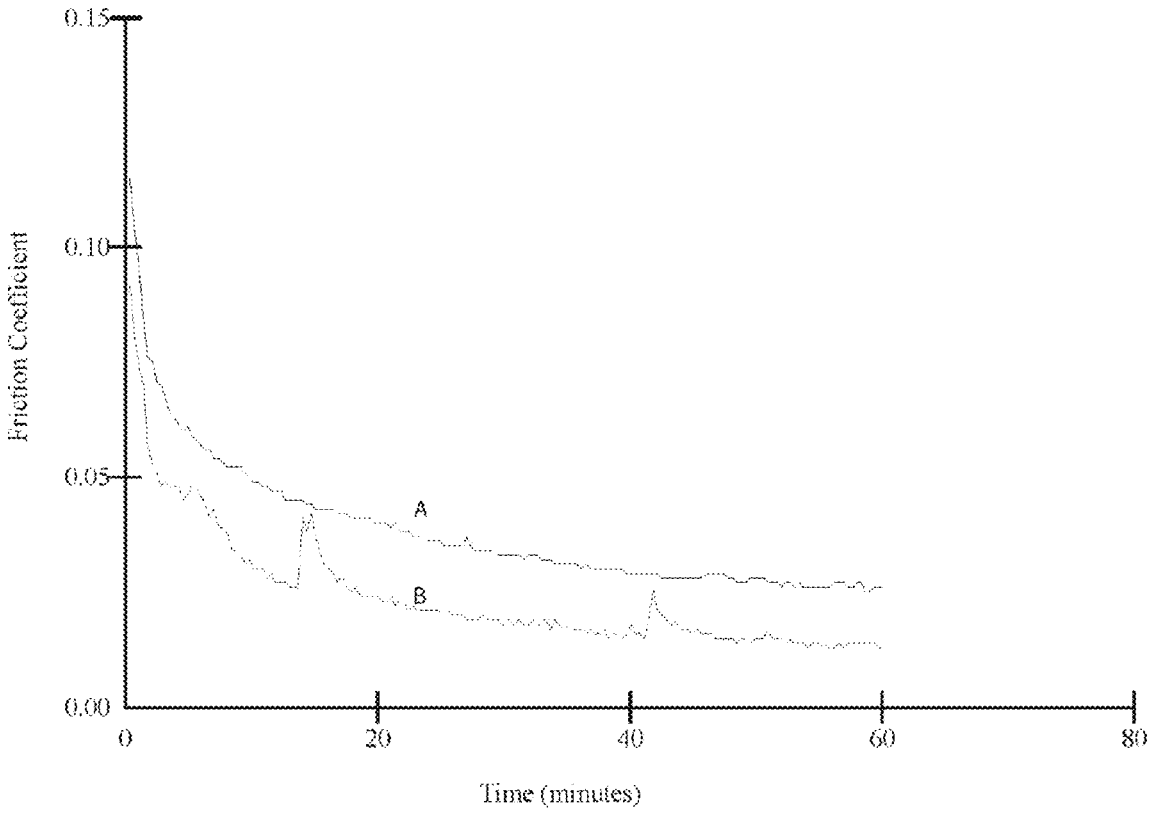
FIG. 3 shows time vs coefficient of friction traces obtained by example 1 hereof wherein 0.12 wt % of bismuth nanoparticles in lubricating oil Aeroshell 555 and Aeroshell 555 alone were separately tested in a Falex multi-specimen tester with an 88 lb load and a rotation speed of 600 RPM. The mean particle size of the nanoparticles was about 60 nm. Coefficient of friction measurements were taken over a period of about 60 minutes.

A mean particle size of about 60 nm is selected for use at 75° C. An initial concentration of about 0.12 wt % with 100 ml of dispersion was selected for use for reducing friction between two thrust washers on a Falex multi-specimen tester with an 88 pound load and a rotation speed of 600 RPM. A heating mantle on the test fixture was used to adjust the temperature to 75° C. Coefficient of friction measurements were taken of a period of about 60 minutes. When 100 ml of the 0.12 wt % bismuth nanoparticle oil dispersion is placed between the two thrust washers and the test load under rotation is applied, the coefficient of friction drops by 50% as compared to the original lubricant oil (Aeroshell 555) at the same test parameters as is shown in FIG. 3 hereof. Trace A is a trace for original lubricant Aeroshell 555 alone and trace B is for a 0.12 wt. % of bismuth nanoparticles dispersed in Aeroshell 555.

Figure 4:
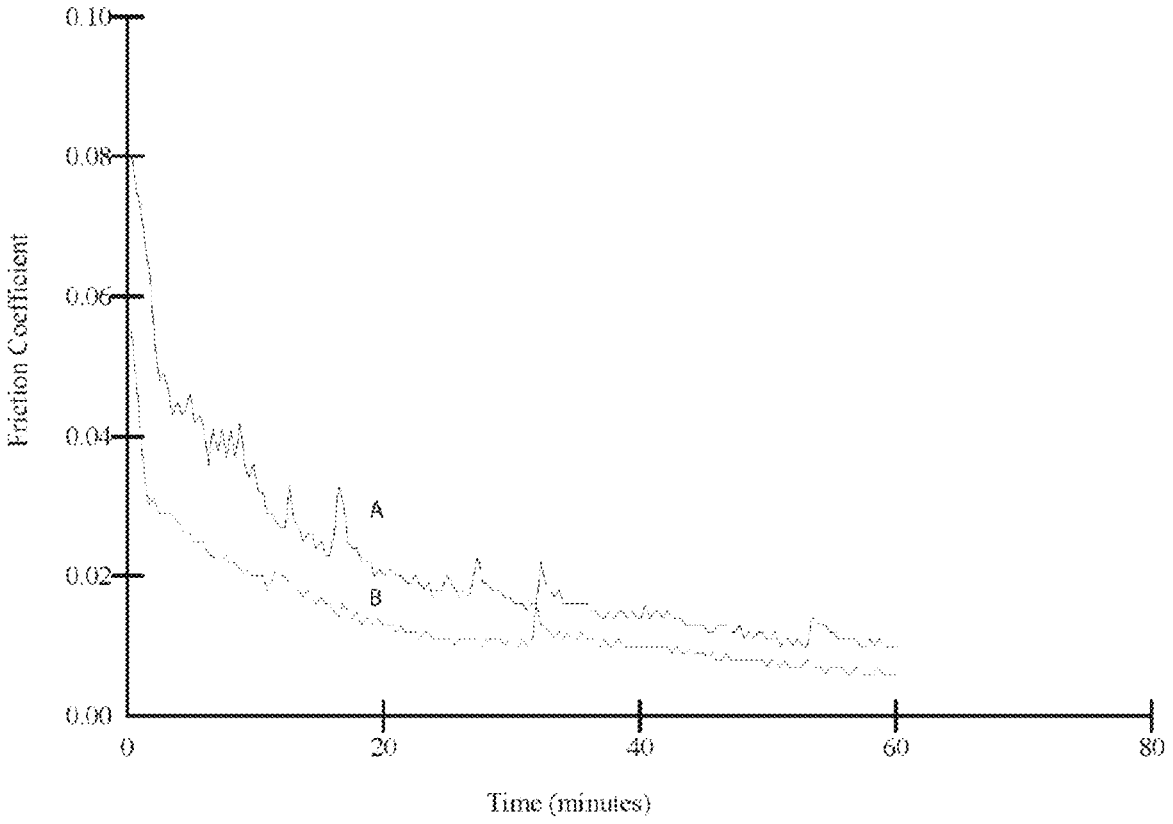
FIG. 4 hereof shows time versus coefficient of friction traces, also from example 1 hereof, with an initial 0.12 wt % bismuth nanoparticle in oil dispersion treatment, then after replacement of the nanoparticle/Aeroshell dispersion with fresh Aeroshell 555 at 75° C.

Replacement of the bismuth nanofluid between the two thrust washers after the testing shown in FIG. 3 with fresh original lubricating oil (Aeroshell 555) reduces the coefficient of friction by a further additional 25% as compared to that obtained when utilizing the 0.12 wt % bismuth nanoparticle oil dispersion when tested at the identical parameters of load, RPM and temperature. This is shown in FIG. 4. Trace B represents the use of the fresh lubricant Aeroshell 555 alone and trace A represents the use of the lubricant Aeroshell 555 containing about 0.12 wt. % bismuth nanoparticles (identical to the time trace in FIG. 3 for the nanofluid). This further reduction in coefficient of friction indicates the formation of a low friction nanocoating on the contact surfaces. When examined by scanning electron microscopy (SEM), the "cobblestone" nanocoating in FIG. 2 hereof was observed on the contact areas of the thrust washers.

Example 2

Figure 5:
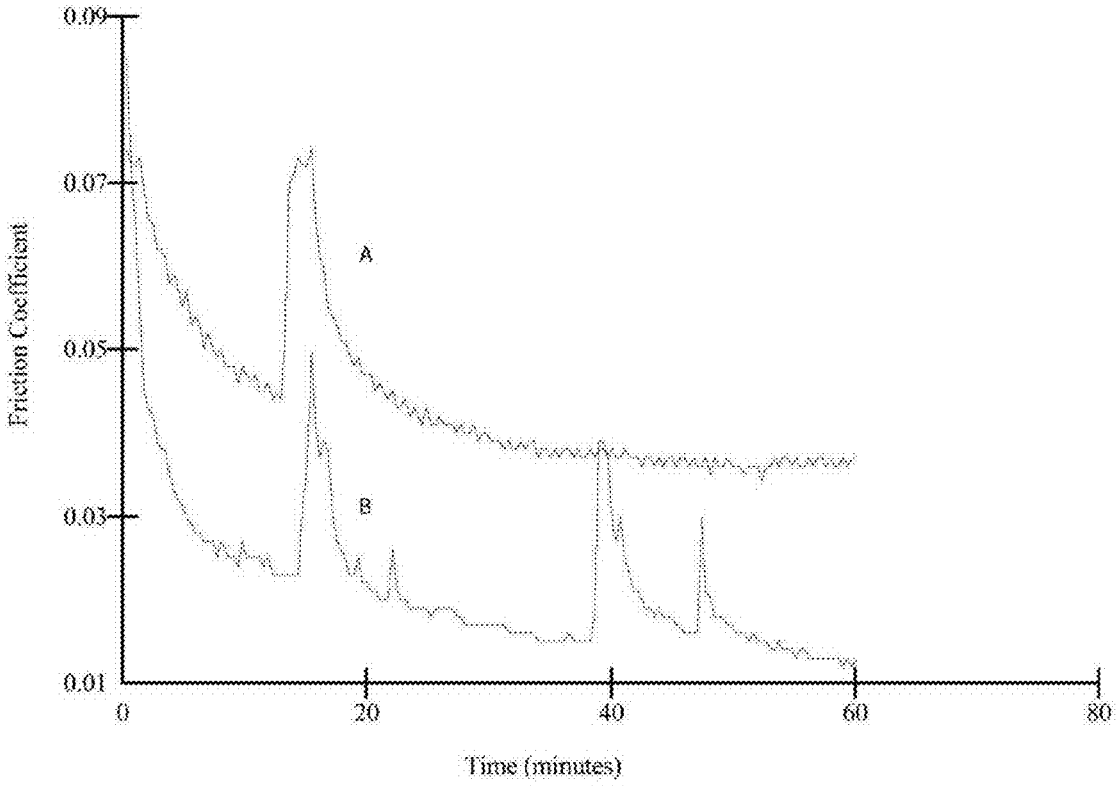
FIG. 5 hereof shows time versus coefficient of friction traces for example 2 hereof showing the comparison of pure Aeroshell 555 run in the Falex-multi-specimen tester compared with and 0.08 wt % bismuth nanoparticle dispersion at 90° C. wherein the mean size of the nanoparticles was about 50 nm.

When the temperature of the heating mantle of the test fixture was raised to 90° C. utilizing the same RPM and load, nanocoating formation and reduction of the coefficient of friction did not occur at the same concentration. However, reduction of the bismuth nanoparticle concentration in the oil does allow the nanocoating formation to occur. For 90° C. with a load of 88 pounds and rotation speed of 600 RPM, the time traces of a 0.08 wt % bismuth nanoparticle oil dispersion is shown in FIG. 5 hereof with the time traces of the same fixture at the same conditions with the plain Aeroshell 555. Trace A is the Aeroshell 555 oil and Trace B is the 0.08 wt % bismuth nanoparticle oil dispersion. A steady decrease of the coefficient of friction is observed.

Example 3

Figure 6:
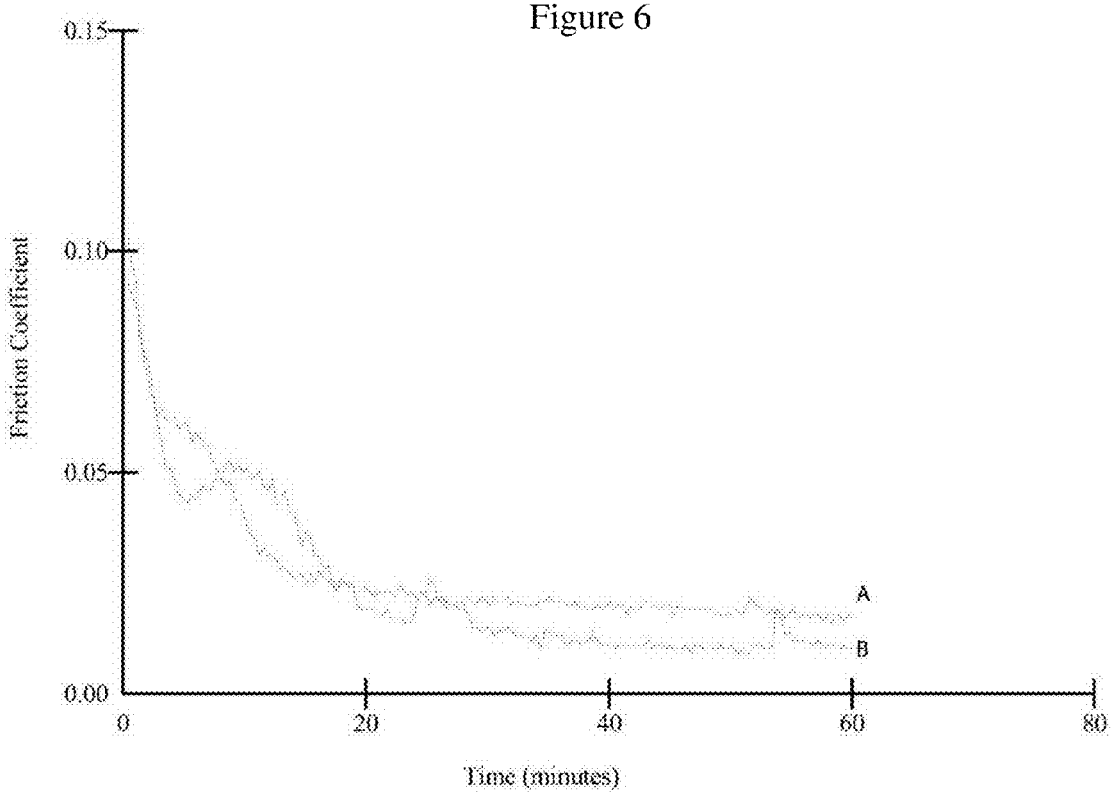
FIG. 6 hereof shows time versus coefficient of friction traces for example 3 hereof for 25 nm bismuth nanoparticle dispersion in Aeroshell 555 dispersion at about 0.05 wt % vs. pure Aeroshell 555 lubricating oil.

When the temperature of the heating mantle of the test fixture is lowered to 45° C. and the other test parameters of load and RPM kept at 88 lbs and 600 RPM, the 60 nm mean particle size no longer forms a nanocoating on the contact surfaces of the thrust washers. However, a 30 nm mean particle size will lower the coefficient of friction as shown in FIG. 6 hereof. Trace A is the Aeroshell 555 at the identical conditions as the 0.05 wt % 30 nm bismuth nanoparticle oil dispersion shown in Trace B.

What is claimed is:

1. A process for preparing a lubricant having coefficient of friction properties, which lubricant is prepared in a system comprised of a heating zone, a lubricant contacting zone, and a collecting zone, wherein all zones are under a vacuum, which process comprising:

a) placing a sample of elemental metal having a melting point less than 400° C. in a heating zone capable of being heated to a temperature of up to about 2000° C.;

b) heating said sample of elemental metal to a temperature between about 900° C. and 1800° C. thereby causing at least a fraction of the elemental metal to melt and evaporate resulting in the formation of metal nanoparticles, metal nanodroplets or both;

c) passing a stream of inert gas through the heating zone so that it passes over the evaporating metal sample and forms a mixture of inert gas and metal nanoparticles, metal nanodroplets, or both;

d) conducting said mixture of inert gas and metal nanoparticles, metal nanodroplets, or both to a lubricant contacting zone wherein the mixture of inert gas and metal nanoparticles, metal nanodroplets, or both come into intimate contact with a mist of lubricant thereby quenching said metal nanoparticles and metal nanodroplets to nanoparticles, thereby resulting in a mixture of inert gas and said lubricant having dispersed therein quenched metal nanoparticles; and e) conducting said mixture of inert gas and said lubricant having dispersed therein quenched metal nanoparticles to a collection zone wherein the inert gas is separated from a dispersion of quenched metal nanoparticles in lubricant.

2. The process of claim 1 wherein the metal is selected from the group consisting of bismuth, cadmium, tin, indium, and lead.

3. The process of claim 2 wherein the metal is bismuth.

4. The process of claim 1 wherein the temperature to which the metal sample is heated in the heating zone is from about 1200° C. to about 1600° C.

5. The process of claim 1 wherein the mean particle size of the metal nanoparticles is from about 2 nm to about 200 nm.

6. The process of claim 5 wherein the mean particle size of the metal nanoparticles is from about 2 to 60 nm.

7. The process of claim 1 wherein the concentration of metal nanoparticles in lubricant is from about 0.02 wt. % to about 2 wt. %.

8. The process of claim 1 wherein the lubricant is selected from lubricating oils and greases.

9. The process of claim 8 wherein the lubricant is a lubricating oil.

10. The process of claim 9 wherein the lubricating oil is a natural lubricating oil.

11. The process of claim 9 wherein the lubricating oil is synthetic lubricating oil.

* * * * *